US005629584A

United States Patent [19]

Borowiec et al.

[11] Patent Number: 5,629,584

[45] Date of Patent: May 13, 1997

[54] ACCURATE PLACEMENT AND RETENTION OF AN AMALGAM IN A ELECTRODELESS FLUORESCENT LAMP

[75] Inventors: Joseph C. Borowiec, Schenectady, N.Y.; Kenneth J. Downton, Leicester, United Kingdom; Sayed-Amr El-Hamamsy, Schenectady, N.Y.

[73] Assignee: General Electric Company, Schenectady, N.Y.

[21] Appl. No.: 448,080

[22] Filed: May 23, 1995

Related U.S. Application Data

[63] Continuation of Ser. No. 131,221, Oct. 4, 1993, abandoned.

[51] Int. Cl.[6] ..... H01J 17/26

[52] U.S. Cl. ..... 313/565; 313/490

[58] Field of Search ..... 313/490, 550, 313/565, 566; 315/248; 445/9, 26, 53, 57

[56] References Cited

U.S. PATENT DOCUMENTS

| | | | |
|---|---|---|---|
| 4,010,400 | 3/1977 | Hollister | 315/248 |
| 4,105,910 | 8/1978 | Evans | 313/490 |
| 4,262,231 | 4/1981 | Anderson et al. | 313/490 |
| 4,437,041 | 3/1984 | Roberts | 315/248 |
| 4,499,400 | 2/1985 | Anderson et al. | 313/490 |
| 4,622,495 | 11/1986 | Smeelen | 315/248 |
| 5,200,672 | 4/1993 | Sheynberg | 315/248 |
| 5,274,305 | 12/1993 | Bouchard | 313/550 |

FOREIGN PATENT DOCUMENTS

| | | | |
|---|---|---|---|
| 0252546 | 6/1987 | European Pat. Off. | H01J 65/04 |
| 0252546 | 1/1988 | European Pat. Off. . | |

OTHER PUBLICATIONS

Patent abstracts of Japan; vol. 10, No. 221 (E–424)(2277) 2 Aug. 1986 & JP–A–61 058 154 (Toshiba Corp.) 25 Mar. 1986.

Patent abstracts of Japan; vol. 13, No. 356 (E–803)(3704) 9 Aug. 1989 & JP–A–01 117 265 (Toshiba Corp.) 10 May 1989.

Patent abstracts of Japan; vol. 2, No. 47 (M–14) 29 Mar. 1978 & JP–A–53 004 378 (Tokyo Shibaura Denki K.K.) 14 Jan. 1978.

Patent abstracts of Japan; vol. 3, No. 137 (M–80) 14 Nov. 1979 & JP–A–54 112 580 (Nippon Denki K.K.) 3 Sep. 1979.

Patent abstracts of Japan; vol. 10, No. 54 (E–385)(2111) 4 Mar. 1986 & JP–A–60 208 023 (Toshiba K.K.) 19 Oct. 1985.

*Primary Examiner*—Michael Horabik
*Assistant Examiner*—Michael Day
*Attorney, Agent, or Firm*—Jill M. Breedlove; Marvin Snyder

[57] ABSTRACT

An amalgam is accurately placed and retained in an optimized location in the exhaust tube of an electrodeless SEF lamp for operation at a mercury vapor pressure in the optimum range from approximately four to seven millitorr by forming a dimple in the exhaust tube and using a dose locating member to locate and retain the amalgam on the side of the dimple away from the core of the lamp after filling the lamp. As an alternative, two dimples may be situated on opposite sides of the exhaust tube for performing the same function as, but with less depth than, the single dimple. In another alternative embodiment, first and second dimple configurations are formed in the exhaust tube after tip-off thereof, each dimple configuration including either one or two dimples. The second dimple configuration is spaced apart from the first dimple configuration along the length of the exhaust tube. In this way, the amalgam may be initially positioned farther from the tip-off region, thereby avoiding problems during tipping off of the exhaust tube, such as loss of mercury from the lamp, or quenching of the tip which could cause stress cracks. After tip-off, the second dimple configuration allows for placement of the amalgam closer to, or preferably in contact with, the tip of the sealed exhaust tube, i.e., the coolest location in the exhaust tube.

14 Claims, 3 Drawing Sheets

ACCURATE PLACEMENT AND RETENTION OF AN AMALGAM IN A ELECTRODELESS FLUORESCENT LAMP

This application is a Continuation of application Ser. No. 08/131,221, filed Oct. 4, 1993, now abandoned.

RELATED APPLICATION

The present invention is related to commonly assigned U.S. patent application Ser. No. 08/130,935, now U.S. Pat. No. 5,434,482, of J. C. Borowiec, H-R Chang and R. A. Senecal, filed concurrently herewith and incorporated by reference herein.

FIELD OF THE INVENTION

The present invention relates generally to fluorescent lamps and, more particularly, to accurate placement and retention of an amalgam in a solenoidal electric field fluorescent discharge lamp for optimally controlling mercury vapor pressure therein, which amalgam placement and retention do not interfere with lamp processing and furthermore are maintained during lamp operation, regardless of lamp orientation.

BACKGROUND OF THE INVENTION

The optimum mercury vapor pressure for production of 2537 Å radiation to excite a phosphor coating in a fluorescent lamp is approximately six millitorr, corresponding to a mercury reservoir temperature of approximately 40° C. Conventional tubular fluorescent lamps operate at a power density (i.e., typically measured as power input per phosphor area) and in a fixture configured to ensure operation of the lamp at or about a mercury vapor pressure of six millitorr (typically in a range from approximately four to seven millitorr); that is, the lamp and fixture are designed such that the coldest spot of the fluorescent lamp is approximately 40° C. Compact fluorescent lamps, however, including electrodeless solenoidal electric field (SEF) fluorescent discharge lamps, operate at higher power densities with the cold spot temperature typically exceeding 50° C. As a result, the mercury vapor pressure is higher than the optimum four to seven millitorr range, and the luminous output of the lamp is decreased.

One approach to controlling the mercury vapor pressure in an SEF lamp is to use an alloy capable of absorbing mercury from its gaseous phase in varying amounts, depending upon temperature conditions. Alloys capable of forming amalgams with mercury have been found to be particularly useful. The mercury vapor pressure of such an amalgam at a given temperature is lower than the mercury vapor pressure of pure liquid mercury.

Unfortunately, accurate placement and retention of an amalgam to achieve a mercury vapor pressure in the optimum range in an SEF lamp are difficult. For stable long-term operation, the amalgam should be placed and retained in a relatively cool location with minimal temperature variation. Of course, to achieve the desired beneficial effects of an amalgam in an SEF lamp, the amalgam should maintain its composition and location during lamp processing and manufacturing steps as well as during lamp operation.

Accordingly, it is desirable to provide an SEF lamp having a properly constituted amalgam that is accurately placed in an optimum location, which amalgam maintains its composition and location during lamp processing as well as during lamp operation, regardless of lamp orientation.

SUMMARY OF THE INVENTION

An amalgam is accurately placed and retained in an optimized location in the exhaust tube of an electrodeless SEF lamp for operation at a mercury vapor pressure in the optimum range from approximately four to seven millitorr by forming an indentation, or dimple, in the exhaust tube and using a dose locating member to locate and retain the amalgam on the side of the dimple away from the core of the lamp after filling the lamp. As an alternative, two dimples may be situated on opposite sides of the exhaust tube for performing the same function as, but with less depth than, the single dimple.

In another alternative embodiment, first and second dimple configurations are formed in the exhaust tube after tip-off thereof, each dimple configuration comprising either one or two dimples. The second dimple configuration is spaced apart from the first dimple configuration along the length of the exhaust tube. In this way, the amalgam may be initially positioned farther from the tip-off region, thereby avoiding problems during tipping off the exhaust tube, such as loss of mercury from the lamp due to overheating of the amalgam, or quenching of the tip which could cause stress cracks. After tip-off, the second dimple configuration allows for placement of the amalgam closer to, or preferably in contact with, the tip of the sealed exhaust tube, i.e., the coolest location in the exhaust tube.

BRIEF DESCRIPTION OF THE DRAWINGS

The features and advantages of the present invention will become apparent from the following detailed description of the invention when read with the accompanying drawings in which.

DETAILED DESCRIPTION OF THE INVENTION

Figure 1:
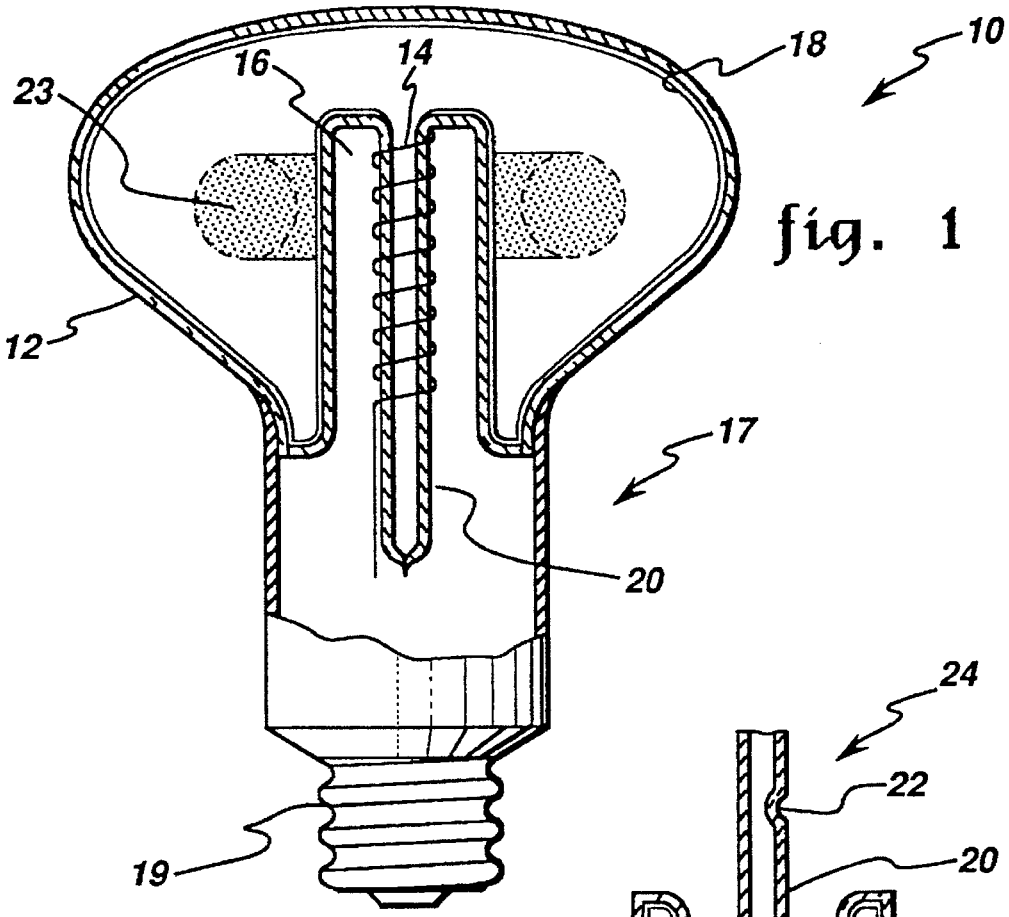
FIG. 1 illustrates, in partial cross section, a typical electrodeless SEF fluorescent discharge lamp.

FIG. 1 illustrates a typical electrodeless SEF fluorescent discharge lamp 10 having an envelope 12 containing an ionizable gaseous fill. Lamp 10 is dosed with the fill via an exhaust tube 20 in well-known manner. A suitable fill, for example, comprises a mixture of a rare gas (e.g., krypton and/or argon) and mercury vapor and/or cadmium vapor. An excitation coil 14 is situated within, and removable from, a re-entrant cavity 16 within envelope 12. For purposes of illustration, coil 14 is shown schematically as being wound about an exhaust tube 20 which is used for filling the lamp. However, the coil may be spaced apart from the exhaust tube and wound about a core of insulating material or may be free standing, as desired. The interior surfaces of envelope 12 are coated in well-known manner with a suitable phosphor 18. Envelope 12 fits into one end of a base assembly 17 containing a radio frequency power supply (not shown) with a standard (e.g., Edison type) lamp base 19 at the other end. Envelope 12 is shown in FIG. 1 in a "base-down", or "crown-up", position.

In operation, current flows in coil 14 as a result of excitation by a radio frequency power supply (not shown). As a result, a radio frequency magnetic field is established within envelope 12 which ionizes and excites the gaseous fill contained therein, resulting in a toroidal discharge 23 and emitting ultraviolet radiation therefrom. Phosphor 18 absorbs the ultraviolet radiation and emits visible radiation as a consequence thereof.

In accordance with the present invention, a properly constituted amalgam is accurately placed and retained in a location optimized for the particular amalgam in an SEF lamp, which amalgam maintains its composition and location during lamp processing as well as during lamp operation, regardless of lamp orientation. Each amalgam has its own optimum range of operating temperatures to provide a mercury vapor pressure of approximately six millitorr.

An exemplary amalgam comprises a combination of bismuth and indium. Another exemplary amalgam comprises pure indium. Still another exemplary amalgam comprises a combination of lead, bismuth and tin, such as described in commonly assigned U.S. Pat. No. 4,262,231 of J. M. Anderson and P. D. Johnson, issued Apr. 14, 1981, which is incorporated by reference herein. Yet another amalgam may comprise zinc or a combination of zinc, indium and tin.

Figure 2A:
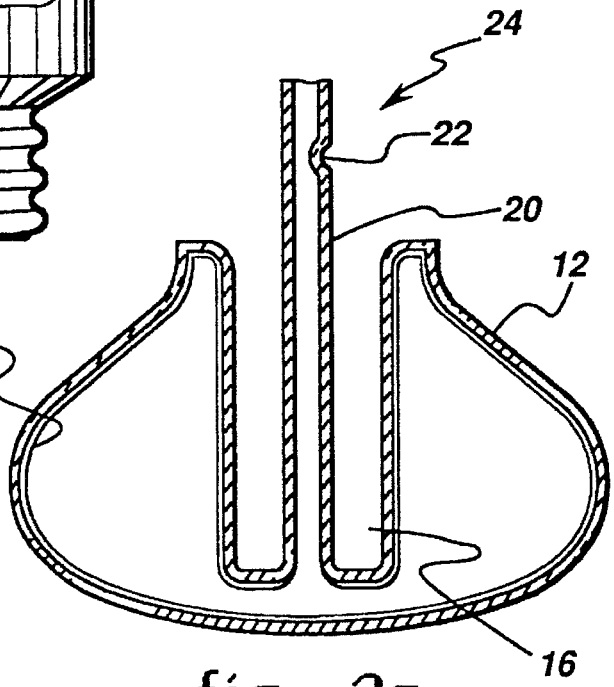
FIGS. 2*a* and 2*b* illustrate, in partial cross section, the use of a single dimple configuration and dose locating member for placing and retaining an amalgam in an SEF lamp according to one embodiment of the present invention.

FIG. 2*a* illustrates an SEF lamp in the crown-down position before the lamp is dosed with a fill through exhaust tube 20. An indentation, or dimple, 22 is situated toward the tip-off region 24 of exhaust tube 20. The tip-off region is the area at the top of the exhaust tube which is sealed, or "tipped off" to form the tip of the exhaust tube after evacuating and filling the lamp therethrough.

Figure 2B:
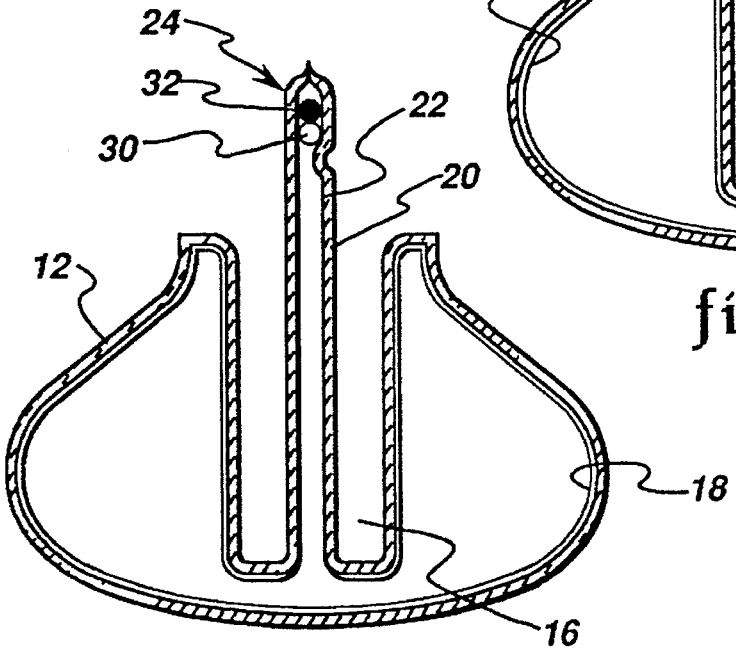

The lamp is evacuated and filled through exhaust tube 20 in well-known manner. Then, as illustrated in FIG. 2*b*, an appropriately sized and shaped dose locating member 30, comprising a glass ball in one embodiment, is inserted into exhaust tube 20 through the opening at the tip-off region. By virtue of the presence of dimple 22 and the size and shape of dose locating member 30, the dose locating member remains on the side of the dimple away from re-entrant cavity 16. An amalgam 32 is then inserted into exhaust tube 20 through the opening at tip-off region 24. The combination of dimple 22 and dose locating member 30 results in placement and retention of the amalgam at a predetermined location on the side of dimple 22 away from re-entrant cavity 16. That is, the location of amalgam 32 is chosen such that the mercury vapor pressure approximates a value in the optimum range of approximately 4 to 7 millitorr during lamp operation. Finally, as illustrated in FIG. 2*b*, the exhaust tube is tipped-off at a location just above amalgam 32.

Figure 3:
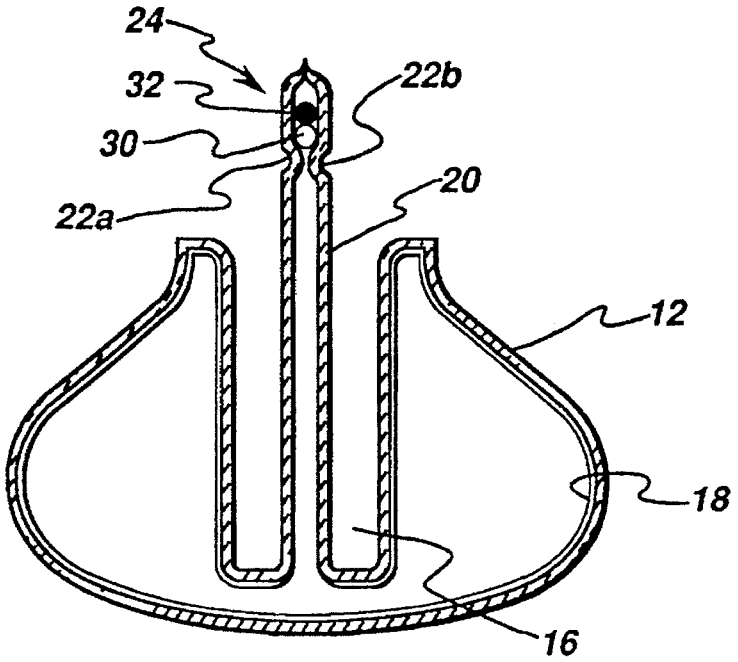
FIG. 3 illustrates, in partial cross section, an alternative embodiment of the dimple configuration of FIGS. 2*a* and 2*b;*

FIG. 3 illustrates an alternative embodiment of the dimple configuration of FIG. 2. As shown, two dimples 22*a* and 22*b* are situated directly across from each other on opposite sides of exhaust tube 20. Dimples 22*a* and 22*b* each preferably have less depth than dimple 22 of FIG. 2, but together perform the same function. Using two dimples to perform the function of a single, but deeper, dimple may be desirable in some lamps because there would be less stress on the glass tube and would furthermore balance the stresses on the glass tube during formation of the dimples.

Figure 4A:
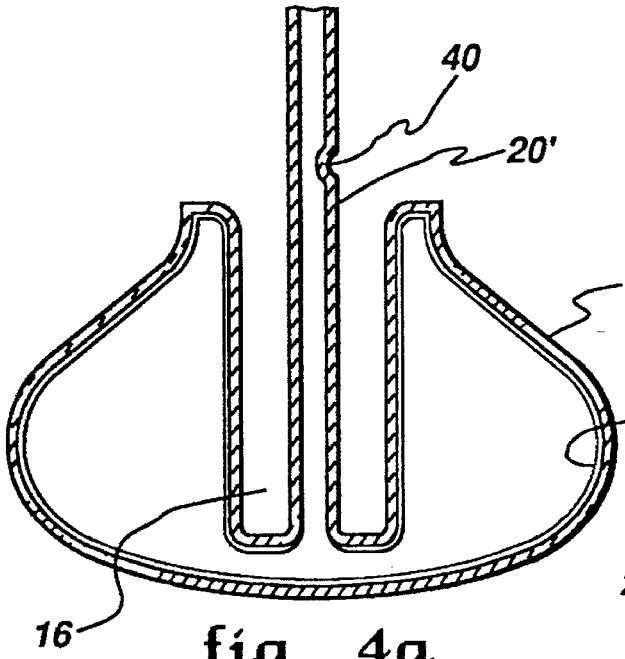
FIGS. 4*a,* 4*b* and 4*c* illustrate, in partial cross section, the use of first and second dimple configurations in combination with a dose locating member for placing and retaining an amalgam in an SEF lamp according to another embodiment of the present invention.
Figure 4B:
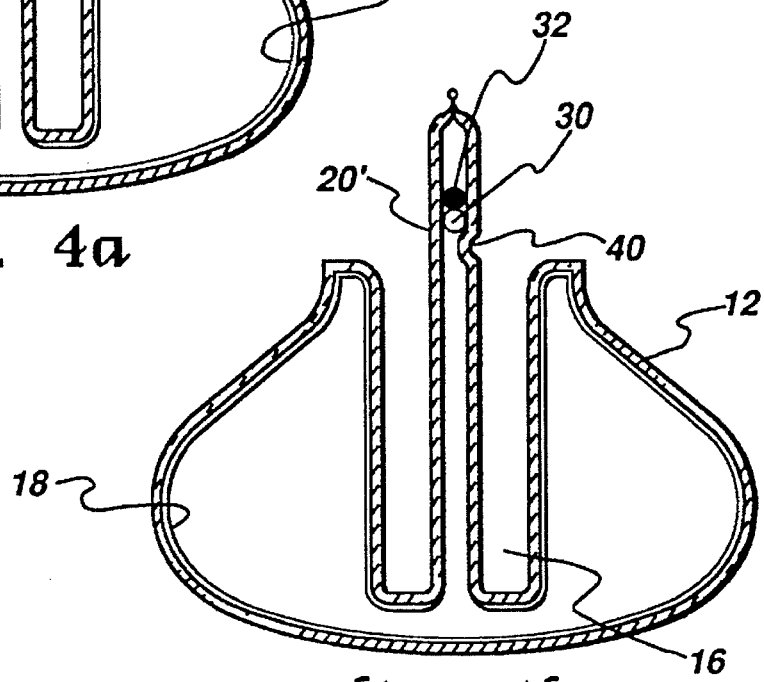
Figure 4C:
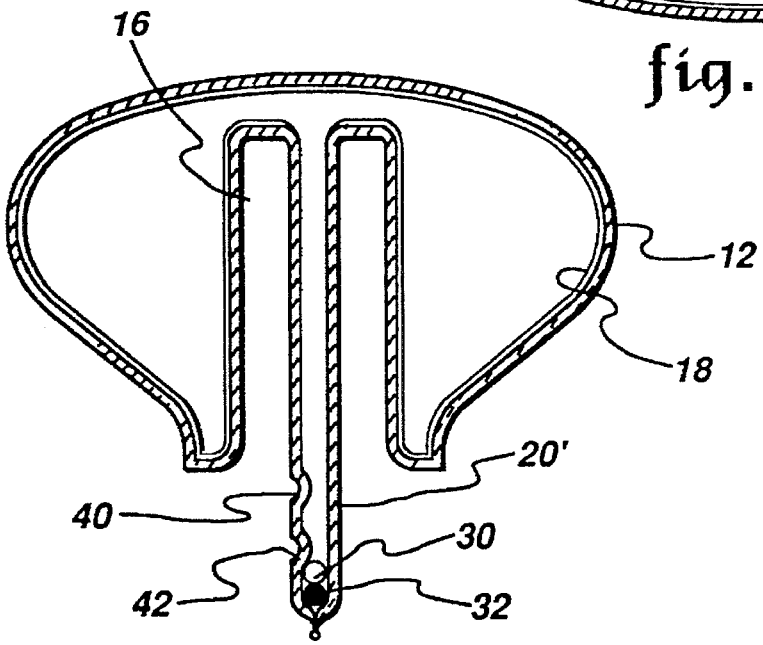

FIGS. 4*a*–4*c* illustrate placement and retention of an amalgam in an SEF lamp according to another embodiment of the present invention. A first dimple 40 is formed in exhaust tube 20' at a location closer to re-entrant cavity 16 than dimple 22 of FIG. 2 (or dimples 22*a* and 22*b* of FIG. 3). The lamp is then evacuated and filled through exhaust tube 20 in well-known manner. An appropriately sized and shaped dose locating member 30, comprising a glass ball in one embodiment, is inserted into exhaust tube 20' through the opening at the tip-off region. The presence of first dimple 40 and the size and shape of dose locating member 30 force dose locating member 30 to remain on the side of the dimple away from re-entrant cavity 16. An amalgam 32 is then inserted into exhaust tube 20' through the opening at the tip-off region. The combination of first dimple 40 and dose locating member 30 results in placement of the amalgam at a first predetermined location (i.e., on the side of first dimple 40 away from re-entrant cavity 16) in the exhaust tube. Then, as illustrated in FIG. 4*b*, the exhaust tube is tipped-off at a location above amalgam 32 such that there is a space between amalgam 32 and the tip of the exhaust tube. The first predetermined location (i.e., the location of amalgam 32) is chosen such that there is sufficient distance between the amalgam and the tip-off region of the exhaust tube to avoid problems during tipping off the exhaust tube, such as loss of mercury from the lamp due to overheating the amalgam, and quenching of the tip which could cause stress cracks. The SEF lamp is then inverted to its crown-up, or base-down, position, as illustrated in FIG. 4*c*, and a second dimple 42 is formed in exhaust tube 20' just above dose locating member 30. Advantageously, use of the two dimple configurations (each of which may comprise one or two dimples) ensures close contact of the amalgam with the tip of the exhaust tube, thus ensuring positioning of the amalgam at or very close to the coldest location in the exhaust tube, while avoiding problems which may otherwise be caused by overheating the amalgam during tip-off, as described hereinabove.

Dose locating member 30 comprises a glass ball in one preferred embodiment. Advantageously, a glass ball may be easily deposited in the exhaust tube by rolling it therein. However, other configurations for the dose locating member may be desired, depending on the application and method for lamp manufacture.

Figure 5:
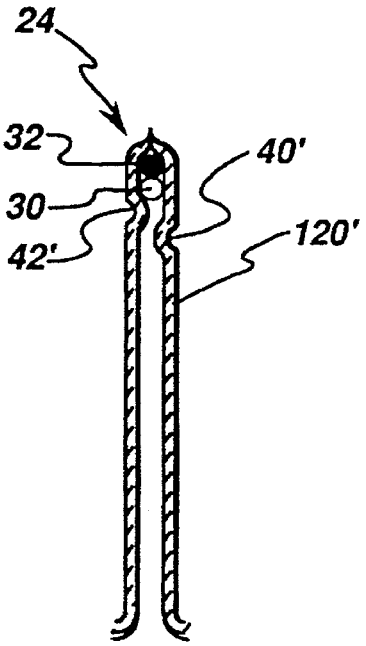
FIG. 5 illustrates, in partial cross section, an alternative embodiment of the use of first and second dimple configurations of FIGS. 4*a,* 4*b* and 4*c;*

FIG. 5 illustrates another alternative embodiment of the present invention wherein two dimple configurations 40' and 42' are situated on opposite sides of exhaust tube 120'. In this way, the two dimple configurations may partially overlap, if desired, in order that they are located in closer proximity to each other along the length of the exhaust tube. Again, locating dimples on both sides of the arc tube, instead of one, may be desirable to reduce and balance the stresses on the glass exhaust tube during formation of the dimples thereon.

Figure 6:
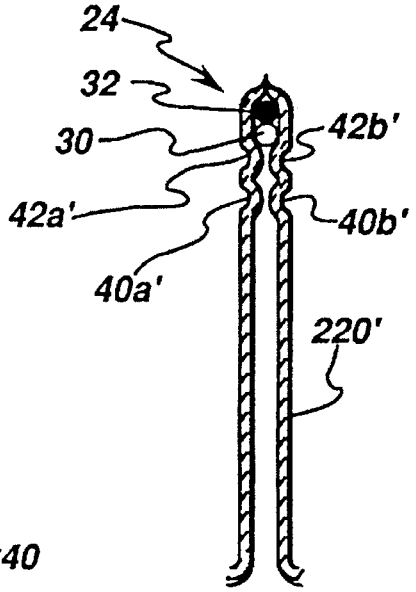
FIG. 6 illustrates, in partial cross section, still another alternative embodiment of the use of first and second dimple configurations.

FIG. 6 illustrates another alternative embodiment of the present invention wherein two dimple configurations are employed, but each dimple configuration comprises two dimples located directly across from each other on opposite sides of exhaust tube 220'. Specifically, as shown, a first dimple configuration comprises dimples 40*a*' and 40*b*', and a second dimple configuration comprises dimples 42*a*' and 42*b*'.

Figure 7:
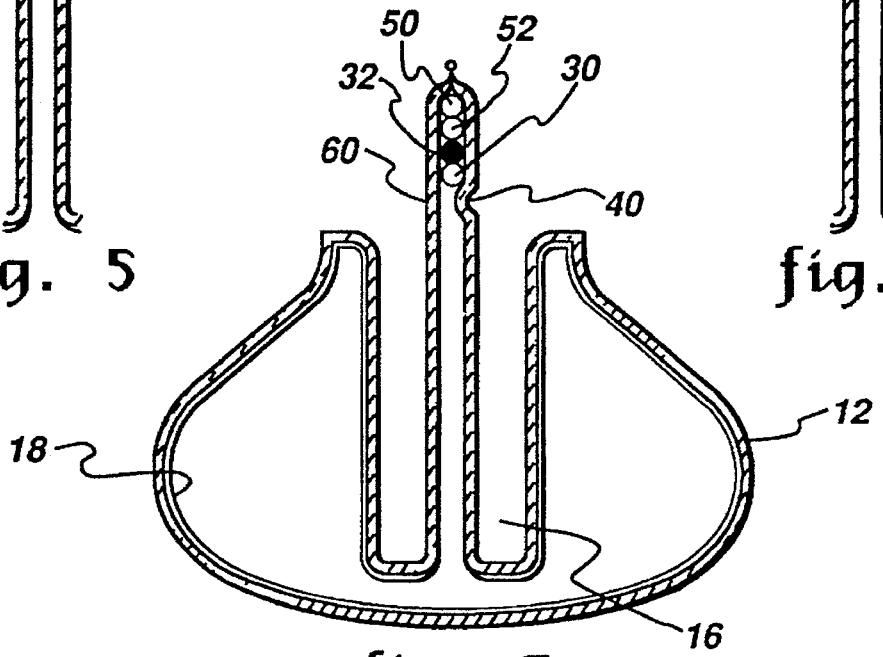
FIG. 7 illustrates, in partial cross section, yet another alternative embodiment of the present invention.

FIG. 7 illustrates another alternative embodiment of the present invention wherein a single dimple configuration is employed, but at least one additional dose locating member is employed on the other side of the amalgam (i.e., toward the tip of the exhaust tube). For purposes of illustration, FIG. 7 shows two additional dose locating members 50 and 52. In combination with dose locating member 30, the additional dose locating members 50 and 52 function to maintain the position of amalgam 32 in exhaust tube 60, while avoiding the step of inverting the lamp to its crown-up position in order to add another dimple. Of course, those of ordinary skill in the art will understand that the principles of the present invention are applicable to electroded fluorescent discharge lamps as well as electrodeless fluorescent discharge lamps.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. An electrodeless fluorescent discharge lamp, comprising:

a light-transmissive envelope containing an ionizable, gaseous fill for sustaining an arc discharge when subjected to a radio frequency magnetic field and for emitting ultraviolet radiation as a result thereof, said envelope having an interior phosphor coating for emitting visible radiation when excited by said ultraviolet radiation, said envelope having a re-entrant cavity formed therein;

an excitation coil contained within said re-entrant cavity for providing said radio frequency magnetic field when excited by a radio frequency power supply;

an exhaust tube extending through said re-entrant cavity and into said envelope for evacuating and filling said lamp, said exhaust tube having a base portion for extension into a base of said lamp;

a dimple configuration formed in said base portion of said exhaust tube at a predetermined distance from said re-entrant cavity;

a dose locating member for retaining an amalgam in a location in said exhaust tube between said dose locating member and the tip of said exhaust tube, mercury vapor pressure within said envelope is maintained within the range from approximately four to seven millitorr during lamp operation; and an additional dose locating member situated between said amalgam and the tip of said exhaust tube.

2. The lamp of claim 1 wherein said dose locating member comprises a glass ball.

3. The lamp of claim 1 wherein said dimple configuration comprises a single dimple in one side of said exhaust tube.

4. The lamp of claim 1 wherein said dimple configuration comprises two dimples formed on opposite sides of said exhaust tube.

5. The lamp of claim 1 wherein said amalgam is selected from the group consisting of: indium; a combination of bismuth and indium; a combination of lead, bismuth and tin; zinc; and a combination of zinc, indium and tin.

6. The lamp of claim 1 wherein said dose locating member and said additional dose locating member each comprise at least one glass ball.

7. An electrodeless fluorescent discharge lamp, comprising:

a light-transmissive envelope containing an ionizable, gaseous fill for sustaining an arc discharge when subjected to a radio frequency magnetic field and for emitting ultraviolet radiation as a result thereof, said envelope having an interior phosphor coating for emitting visible radiation when excited by said ultraviolet radiation, said envelope having a re-entrant cavity formed therein;

an excitation coil contained within said re-entrant cavity for providing said radio frequency magnetic field when excited by a radio frequency power supply;

an exhaust tube extending through said re-entrant cavity and into said envelope for evacuating and filling said lamp, said exhaust tube having a base portion for extension into a base of said lamp;

a first dimple configuration formed in said base portion of said exhaust tube at a predetermined distance away from said re-entrant cavity;

a dose locating member for retaining an amalgam in said exhaust tube at a first predetermined location in contact with said dose locating member during tip-off of said exhaust tube, said first predetermined location providing sufficient distance between said amalgam and the tip-off region of said exhaust tube to avoid vaporization of said amalgam during tip-off; and a second dimple configuration formed in said base portion of said exhaust tube at a second predetermined distance from said re-entrant cavity such that said amalgam is retained at a second predetermined location substantially at the tip-off of said exhaust tube during lamp operation, mercury vapor pressure within said envelope is maintained in the range from approximately four to seven millitorr during lamp operation.

8. The lamp of claim 7 wherein said dose locating member comprises a glass ball.

9. The lamp of claim 7 wherein said second predetermined location is selected such that said amalgam is in contact with the tip of said exhaust tube after said exhaust tube is tipped off.

10. The lamp of claim 7 wherein said first and second dimple configurations each comprise a single dimple formed in the same side of said exhaust tube.

11. The lamp of claim 7 wherein said first and second dimple configurations each comprise a single dimple formed in an opposite side of said exhaust tube.

12. The lamp of claim 11 wherein said first and second dimple configurations partially overlap along the length of said exhaust tube.

13. The lamp of claim 7 wherein at least one of said first and second dimple configurations comprises two dimples formed directly opposite each other on opposite sides of said exhaust tube.

14. The lamp of claim 7 wherein said amalgam is selected from the group consisting of: indium; a combination of bismuth and indium; a combination of lead, bismuth and tin; zinc; and a combination of zinc, indium and tin.

* * * * *